US006812644B2

(12) United States Patent
Natchev et al.

(10) Patent No.: US 6,812,644 B2
(45) Date of Patent: Nov. 2, 2004

(54) REDUCED MERCURY CERAMIC METAL HALIDE LAMP

(75) Inventors: Nikolay Natchev, Manchester, NH (US); Lori R. Brock, Gloucester, MA (US); Harold L. Rothwell, Jr., Hopkinton, NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/357,790

(22) Filed: Feb. 4, 2003

(65) Prior Publication Data

US 2004/0150336 A1 Aug. 5, 2004

(51) Int. Cl.[7] ..... H01J 17/16; H01J 61/30

(52) U.S. Cl. ..... 313/634; 313/620; 313/623; 313/637; 313/638; 313/639; 313/641; 313/624; 313/571; 313/573

(58) Field of Search ..... 313/620–624, 313/631, 634, 637–639, 641–643, 25

(56) References Cited

U.S. PATENT DOCUMENTS

| | | | | | |
|---|---|---|---|---|---|
| 4,161,672 | A | * | 7/1979 | Cap et al. | 313/620 |
| 4,409,517 | A | * | 10/1983 | Van Der Sande et al. | 313/631 |
| 4,808,876 | A | * | 2/1989 | French et al. | 313/25 |
| 5,220,244 | A | * | 6/1993 | Maseki et al. | 313/620 |
| 5,936,351 | A | * | 8/1999 | Lang | 313/634 |
| 6,555,962 | B1 | * | 4/2003 | Jackson et al. | 313/623 |

* cited by examiner

*Primary Examiner*—Nimeshkumar D. Patel
*Assistant Examiner*—Sikha Roy
(74) *Attorney, Agent, or Firm*—William E. Meyer

(57) ABSTRACT

Arc tube (10) has a bulbous body (12) with a hollow center portion (14) and opposite ends (16, 18). Each of these ends has a cylindrical terminal-receiving section (20, 22) extending therefrom. The hollow center portion (14) has an internal length A and an internal diameter B that provides an aspect ratio of less than 5 and an outer surface area to inner surface area ratio, measured in square units, of less than 1.5. Electrodes (24) and (26) are hermetically sealed in the terminal-receiving sections (20, 22). The lamp uses less than 7 mgs of mercury. The low pressure operation allows the use of the arc tube in lamps without a shroud and the low mercury allow the lamp to pass TCLP requirement and be conventionally landfilled.

8 Claims, 2 Drawing Sheets

| HORIZONTAL OPERATION | | | | | | | | | | |
|---|---|---|---|---|---|---|---|---|---|---|
| ELECTRODE INSERTION LENGTH = 25 MM PRESSURE ARGON = 50 TORR | | | | | | | | | | |
| Cavity (mm) | Hg (mg) | Power Wrms | Volts Vrms | Amps Arms | Lumens (lm) | LPW (lm/W) | CCT (K) | CRI | X | Y |
| 62 | 4.7 | 404 | 111 | 4.4 | 36487 | 90.3 | 4366 | 87 | 0.3623 | 0.3485 |
| 52 | 5.87 | 400 | 107 | 4.4 | 37642 | 94.1 | 4462 | 86 | 0.3584 | 0.3443 |
| 42 | 6.84 | 400 | 101 | 4.67 | 35070 | 88 | 4725 | 86 | 0.3607 | 0.3364 |

Fig. 3

| VERTICAL OPERATION | | | | | | | | | | |
|---|---|---|---|---|---|---|---|---|---|---|
| ELECTRODE INSERTION LENGTH = 25 MM PRESSURE ARGON = 50 TORR | | | | | | | | | | |
| Cavity (mm) | Hg (mg) | Power Wrms | Volts Vrms | Amps Arms | Lumens (lm) | LPW (lm/W) | CCT (K) | CRI | X | Y |
| 52 | 5.87 | 401 | 96 | 4.96 | 34080 | 84.9 | 4555 | 81 | 0.3586 | 0.3809 |
| 42 | 6.84 | 400 | 94.4 | 5.02 | 32340 | 80.8 | 4490 | 81 | 0.3582 | 0.3347 |

Fig. 4

REDUCED MERCURY CERAMIC METAL HALIDE LAMP

TECHNICAL FIELD

This invention relates to arc discharge lamps and more particularly to metal halide lamps. Still more particularly it relates to metal halide lamps that will operate at low pressures (i.e., about 1.5 atmospheres and thus capable of operation without a shroud) and with a minimum amount of mercury allowing the expired lamps to be conventionally landfilled.

BACKGROUND ART

Many arc discharge lamps contain elemental mercury. During lamp operation, chemical reactions take place that convert some of the elemental mercury to salts or compounds, such as mercuric oxide (HgO), that are water soluble. There is a growing concern that a waste stream resulting from the disposal of fluorescent lamps may leach excessive amounts of this soluble form of mercury (Hg) into the environment. An acceptable method of measuring the amount of soluble mercury which may leach from the waste stream resulting from the disposal of discharge lamps is described in the Toxicity Characteristic Leaching Procedure (TCLP) prescribed on pages 26987–26998 of volume 55, number 126 of the Jun. 29, 1990 issue of the Federal Register. The lamp to be tested is pulverized into granules having a surface area per gram of materials equal to or greater than 3.1 $cm^2$ or having a particle size smaller than 1 cm in its narrowest dimension. The granules are then subject to a sodium acetate buffer solution having a pH of approximately 4.9 and a weight twenty times that of the granules. The buffer solution is then extracted, and the concentration of mercury is measured. At the present time, the United States Environmental Protection Agency (EPA) defines a maximum concentration level for mercury to be 0.2 milligram of leachable mercury per liter of leachate fluid when the TCLP is applied. According to the present standards, an arc discharge lamp is considered nonhazardous (and thus available to be conventionally landfilled) when less than 0.2 milligram per liter of leachable mercury results using the TCLP. Lamps that have leachable mercury concentrations above the allowable limit must be especially disposed of through licensed disposal operations. Disposal operators charge a fee for disposal of lamps that are not within the EPA's limits. Therefore, customers must pay extra costs to dispose of these lamps. Customers of arc discharge lamps generally desire not to contend with disposal issues regarding mercury levels, and therefore some customers specify only those lamps, which pass the TCLP standard.

Additionally, discharge amps generally designated as metal halide lamps often have arc tubes that operate at high pressure (i.e., up to 8 atmospheres) and are required to be shielded to offer protection in the event of an arc tube failure. Such shielding is usually accomplished by the provision of a tubular shroud, which surrounds the arc tube. While workable, the shroud adds expense to the cost of the lamp.

DISCLOSURE OF INVENTION

It is, therefore, an object of the invention to obviate the disadvantages of the prior art.

It is another object of the invention to enhance the operation of arc discharge lamps.

It is another object of the invention to provide a low-pressure arc tube and thus reduce the cost of arc discharge lamps by eliminating shrouds.

Yet another object of the invention is the provision of an arc tube, and thus a lamp, that can pass required TCLP testing.

Still another object of the invention is the provision of a low pressure lamp that will work on existing ballasts.

These objects are accomplished, in one aspect of the invention, by the provision of a ceramic arc tube for a metal halide lamp. The arc tube has a bulbous body with a hollow center portion and opposite ends; each of the opposite ends having a cylindrical, terminal-receiving section extending therefrom. The bulbous body has an aspect ratio <5 and an outer surface to inner surface ratio, measured in square units, of less than 1.5. As used herein the term "aspect ratio" refers to the internal length of the arc chamber divided by the internal radius diameter.

These objects are additionally accomplished, in another aspect of the invention, by the provision of a shroudless metal halide lamp that comprises an hermetically sealed outer envelope terminating in a base at one end and having a ceramic arc tube operatively mounted within the outer envelope. The arc tube comprises a bulbous body having ends and an electrode hermetically sealed in each of the ends and extending internally and externally thereof, the electrodes being operatively connectable to a source of electrical power through the base of the lamp. The bulbous body has an aspect ratio of less than 5 and an outer surface area to inner surface area ratio, measured in square units, of less than 1.5. An arc generating and sustaining medium is contained within the bulbous body, the medium containing additives to generate a particular color emission when the arc tube is operating and an amount of mercury sufficient to provide the arc tube with an operating pressure of about 1.5 atmospheres or less.

The low operating pressure allows the lamp to operate without an internal shroud to protect the arc tube and the low aspect ratio of less than 5 lets the lamp operate with a quantity of mercury small enough for the lamp to pass the TCLP test.

BRIEF DESCRIPTION OF THE DRAWINGS

FIG. 3 is a photometry data table for lamps made in accordance with an aspect of the invention when operated in a first mode; and FIG. 4 is a similar table of data for lamps made in accordance with an aspect of the invention when operated in a second mode.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
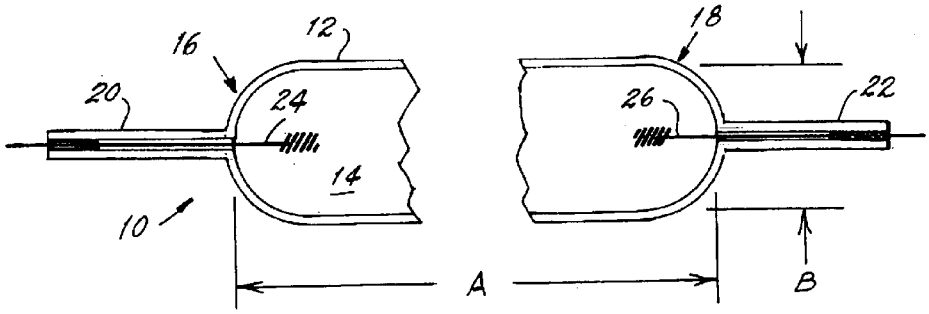
FIG. 1 is an elevational, sectional view of an embodiment of the invention.

Referring now to the drawings with greater particularity, there is shown in FIG. 1 an arc tube 10 comprised of a suitable ceramic material such as polycrystalline alumina. Arc tube 10 has a bulbous body 12 with a hollow center portion 14 and opposite ends 16, 18. Each of these ends has a cylindrical terminal-receiving section 20, 22 extending therefrom. The hollow center portion 14 has an internal length A and an internal diameter B that provides an aspect ratio of less than 5 and an outer surface area to inner surface area ratio, measured in square units, of less than 1.5. Electrodes 24 and 26 are hermetically sealed in the terminal-receiving sections 20, 22.

Figure 2:
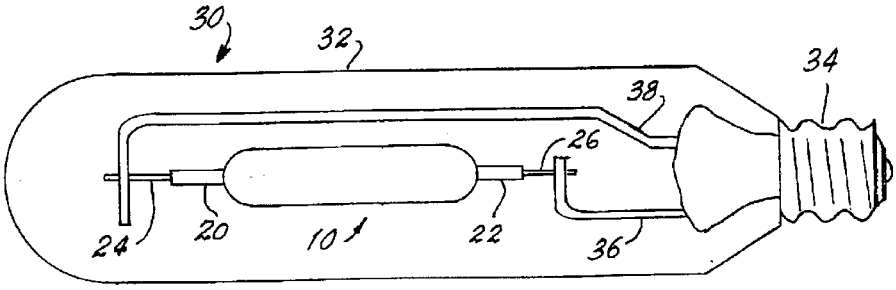
FIG. 2 is an elevational view, partially in section, of an additional embodiment of the invention.

An exemplary lamp 30 is shown diagrammatically in FIG. 2 comprising an envelope 32 terminating in a base 34. In-leads 36, 38 are appropriately electrically connected to the base 34 and extend inwardly of envelope 30 and provide support for arc tube 10, which is electrically connected to the appropriate in-lead through electrodes 24 and 26.

Specific embodiments of the invention are itemized in FIG. 3 (for horizontal operation) and FIG. 4 (for vertical operation). Referring specifically to FIG. 3, the output of three lamps with three cavity sizes having, respectively, internal lengths A, of 62, 52 and 42 mm are shown. In each instance the internal diameter B was 12.5 mm.

In FIGS. 3 and 4 the Power, Volts and Amps are calculated by the root mean square (rms) method; the correlated color temperature (CCT) is in degrees Kelvin; CRI refers to the color rendering index; and X and Y represent the color coordinates on the ICI diagram (International Commission on Illumination) which is also known, especially in England and the European continent as the CIE (Commission Internationale d'Eclairage) system or diagram.

Table I provides the aspect ratios and surface area ratios, as well as the wall loadings and volumes, for these lamps.

TABLE I

| Lamp Type at 400 W (Cavity) | Aspect Ratio | Outside Surface ($cm^2$) | Inside Surface ($cm^2$) | Wall Loading ($W/cm^2$) | Volume ($cm^3$) | Surface Area Ratio (O/I) |
|---|---|---|---|---|---|---|
| 62 mm | 4.96 | 35.05 | 26.68 | 15 | 7.18 | 1.31 |
| 52 mm | 4.16 | 30.34 | 22.75 | 17.58 | 5.95 | 1.33 |
| 42 mm | 3.36 | 25.62 | 18.82 | 21.25 | 4.72 | 1.36 |

All of the lamps operated at about 1.5 atmospheres. At this pressure no external shroud was necessary and any burst of the arc tube was completely contained by the outer envelope of the lamp. Actually, at this operating pressure it was extremely difficult to cause the arc tube to shatter even for testing purposes.

Each of the lamps additionally included an additive mixture of rare earth halides, as is known in the art, (as well as 50 Torr of argon for starting purposes), to provide a particular color output. With operation at this low pressure keeping the aspect ratios below 5 is particularly important for reducing metal additive segregation and providing reasonable operation in both the horizontal and vertical modes. Without the control of the aspect ratios, low pressure operation usually results in locally high wall temperatures when operating horizontally (caused by bowing of the arc) and large metal additive segregation when operated vertically.

An additional important consideration for the low mercury, low pressure operation of this lamp resides in the rounded ends of the arc tube. Previous ceramic arc tubes generally provided a cylindrical body with "square" ends. The rounded shape of the arc tube of this invention decreases the temperature gradient in the end-well regions and improves both color and CRI. While the actual degree of curvature is not critical it must be greater than zero, i.e., not square and preferably is substantially equal to the radius of the arc tube.

To reach the objectives of low pressure, low mercury and good color response a balance between operating pressure, lamp voltage, and arc tube wall temperature must be maintained. These 400 watt lamps are designed to operate on a magnetic ballast at 100 volts. To get this balance between the arc tube geometry (arc tube volume and arc gap) and mercury dose to achieve the desired 100 volts and low operating pressure requires an aspect ration of less than 5 and preferably between 3 and 5 and a mercury dose between 4 and 7 mg. Previous metal halide lamps have included mercury doses of greater than 50 mgs. These prior art lamps, of course, could not meet TCLP requirements and demanded separate handling at the end-of-life.

Accordingly, there is here provided a metal halide lamp that will operate without a shroud, provide good color rendition and operate in either a horizontal or vertical mode. Additionally, the low quantity of mercury used in the lamp allows expired lamps to pass the TCLP requirements and be conventionally landfilled. These features greatly reduce the cost of lamps.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A ceramic arc tube for a metal halide lamp comprising:

a bulbous body defining a cavity, said cavity having a length of at least 42 mm and a diameter of 12.5 mm, and having ends and an electrode hermetically sealed in each of said ends and extending internally and externally thereof;

said bulbous body having an aspect ratio <5 and an outer surface area to inner surface area ratio, measured in square units, of less than 1.5; and an arc generating and sustaining medium contained within said bulbous body, said medium containing additives to generate a particular color emission when said arc tube is operating and an amount of mercury sufficient to provide said arc tube with an operating pressure of about 1.5 atmospheres or less.

2. A shroudless metal halide lamp comprising:

an hermetically sealed outer envelope terminating in a base at one end:

a ceramic arc tube operatively mounted within said outer envelope, said arc tube comprising a bulbous body defining a cavity, said cavity having a length of at least 42 mm and a diameter of 12.5 mm, and having ends and an electrode hermetically sealed in each of said ends and extending internally and externally thereof, said electrodes being operatively connectable to a source of electrical power through said base;

said bulbous body having an aspect ratio <5 and an outer surface area to inner surface area ratio, measured in square units, of less than 1.5; and an arc generating and sustaining medium contained within said bulbous body, said medium containing additives to generate a particular color emission when said arc tube is operating and an amount of mercury sufficient to provide said arc tube with an operating pressure of about 1.5 atmospheres or less.

3. The lamp of claim 2 wherein said aspect ratio is 4.96.

4. The lamp of claim 2 wherein said aspect ratio is 4.16.

5. The lamp of claim 2 wherein said aspect ratio is 3.36.

6. The lamp of claims 3, 4, or 5 wherein said lamp operates at 400 watts.

7. The lamp of claim 6 wherein said amount of mercury is between 4 and 7 mg.

8. The lamp of claim 6 wherein said lamp operates either vertically or horizontally with minimal additive separation.

* * * * *